US005936922A

United States Patent [19]

Jung et al.

[11] Patent Number: 5,936,922

[45] Date of Patent: Aug. 10, 1999

[54] METHOD AND APPARATUS FOR SAMPLING A SYNCHRONOUS PATTERN FROM DATA INCLUDING AN ERROR USING A RANDOM SYNCHRONOUS SIGNAL

[75] Inventors: Ji-Won Jung; Seung-Hyun Nam, both of Kyeongki-Do, Rep. of Korea

[73] Assignee: Daewoo Electronics Co., Ltd., Seoul, Rep. of Korea

[21] Appl. No.: 08/866,070

[22] Filed: May 30, 1997

[51] Int. Cl.[6] ..... G11B 7/00

[52] U.S. Cl. ..... 369/48; 360/51; 386/48

[58] Field of Search ..... 369/47–48, 50, 369/54, 58, 59; 360/40, 48, 49, 51, 53; 386/48, 66, 84, 124

[56] References Cited

U.S. PATENT DOCUMENTS

| | | | |
|---|---|---|---|
| 4,674,088 | 6/1987 | Grover . | |
| 4,752,837 | 6/1988 | DeLand, Jr. | 360/51 |
| 5,047,877 | 9/1991 | Herting . | |
| 5,553,043 | 9/1996 | Yamaguchi et al. | 369/50 |
| 5,572,496 | 11/1996 | Hayashi et al. . | |
| 5,668,840 | 9/1997 | Takano . | |

FOREIGN PATENT DOCUMENTS

| | | |
|---|---|---|
| 0 630 016 | 12/1994 | European Pat. Off. . |
| 0 640 967 | 3/1995 | European Pat. Off. . |

*Primary Examiner*—W. R. Young

*Attorney, Agent, or Firm*—Pillsbury Madison & Sutro LLP

[57] ABSTRACT

In a method for exactly sampling a synchronous pattern from read data including an error from a recording medium and an apparatus for carrying out the method, a system clock signal is received and the starting portion of each data region concerning the read data from the recording medium having a track structure is counted by using the received system clock signal. The counting value is compared with a standard counting value and the present data region is judged according to the compared result. A same random synchronous signal as a synchronous pattern concerning the data region judged from each data region of the read data, is generated. A first and a second sampling signals are generated in a synchronization block of a unit based on the first and the second synchronous pattern generated from the random synchronous signal. A normal synchronous pattern concerning each data region is sampled based on the random synchronous signal and on the first and the second sampling signals. An accurate synchronous pattern concerning each data region can be obtained irrespective of the presence of an error.

16 Claims, 4 Drawing Sheets

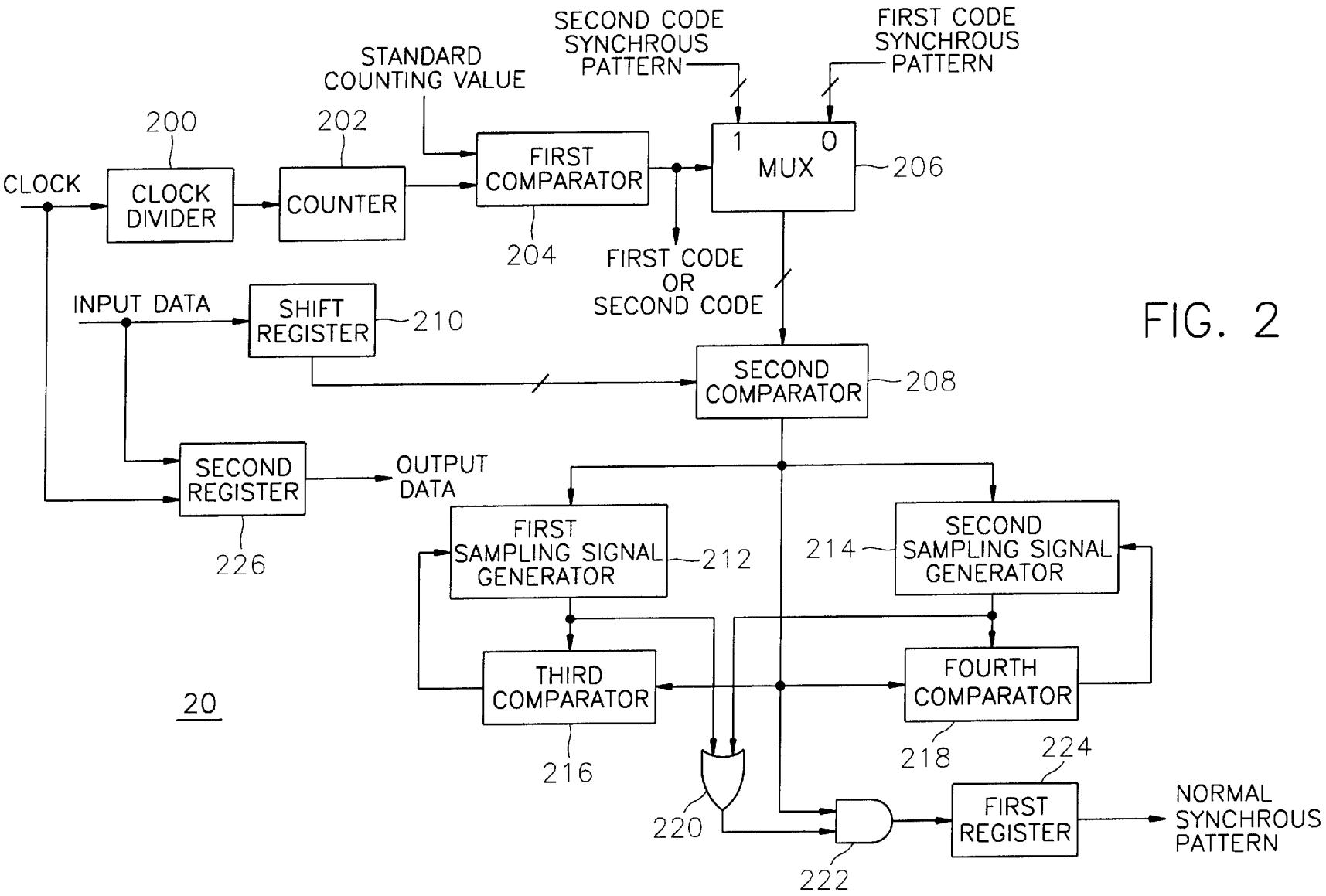
FIG. 2
CLOCK
CLOCK DIVIDER
200
COUNTER
202
STANDARD COUNTING VALUE
FIRST COMPARATOR
204
SECOND CODE SYNCHROUS PATTERN
FIRST CODE SYNCHROUS PATTERN
MUX
0
1
206
FIRST CODE OR SECOND CODE
SECOND COMPARATOR
208
INPUT DATA
SHIFT REGISTER
210
SECOND REGISTER
226
OUTPUT DATA
FIRST SAMPLING SIGNAL GENERATOR
212
SECOND SAMPLING SIGNAL GENERATOR
214
THIRD COMPARATOR
216
FOURTH COMPARATOR
218
220
222
FIRST REGISTER
224
NORMAL SYNCHROUS PATTERN
20

METHOD AND APPARATUS FOR SAMPLING A SYNCHRONOUS PATTERN FROM DATA INCLUDING AN ERROR USING A RANDOM SYNCHRONOUS SIGNAL

BACKGROUND OF THE INVENTION

1. Field of the Invention

The present invention relates to a method and an apparatus for sampling a synchronous pattern, and particularly to a method and an apparatus for exactly sampling a synchronous pattern from data including an error.

2. Description of the Prior Art

Generally, in order to read data recorded in digital data form from a video tape for a video cassette recorder (VCR) or a digital-video home system (D-VHS) and reproduce an original image, an accurate judging of each data region from the read data and a logical operation appropriate to the judged data region should be carried out. Presently, the judging of the data region is accomplished by sampling a synchronous pattern concerning each data region from the read data of the video tape. However, in the read data from the video tape, an error component due to the frequent generation of a bit impact, a bit insertion, a bit deletion, etc. is included because of a defect of the video tape or an external factor. Also, there is a probability that the read data may include the same data as the synchronous pattern. Accordingly, the exact sampling of the synchronous pattern from the read data of the video tape is difficult.

U.S. Pat. No. 4,674,088 (issued to Wayne D. Grover) discloses an example of a method for sampling a synchronous pattern. In this patent, a method for sampling synchronization with frames of a serial data stream including a predetermined frame pattern is disclosed.

SUMMARY OF THE INVENTION

Accordingly, it is an object of the present invention considering the above-mentioned problem to provide a method for exactly sampling a synchronous pattern concerning each data region from read data including an error from a recording medium.

Another object of the present invention is to provide an appropriate apparatus for accomplishing the method for sampling the synchronous pattern.

To accomplish the object of the present invention, there is provided a method for sampling a synchronous pattern comprising the steps of receiving a system clock signal, counting a value using the received system clock signal for differentiating each data region concerning read data from a recording medium having track structure, comparing the counting value with a standard counting value, judging a present data region according to the compared result, generating a random synchronous signal when data which are identical with a synchronous pattern concerning the judged data region from each data region of the read data are read, generating a first and a second sampling signals in a synchronization block of a unit based on a first and a second synchronous patterns generated from the random synchronous signals respectively, correcting the first and second sampling signals when the first and second sampling signals are not identical with the random synchronous signal and sampling a normal synchronous pattern concerning each data region based on the random synchronous signal, the first sampling signal, and the second sampling signal.

Another object of the present invention can be accomplished by an apparatus for sampling a synchronous pattern comprising a counter for receiving a system clock signal and for counting a value using the system clock signal for differentiating each data region concerning read data from a recording medium having track structure, a first comparator for comparing a counting value obtained by the counter with a standard counting value and for judging a present data region, a multiplexer for receiving a compared resulting signal of the first comparator and for selectively outputting a synchronous pattern of a first code and a synchronous pattern of a second code according to the compared resulting signal, a second comparator for comparing an outputted signal of the multiplexer with a pattern of the read data inputted in serial and for outputting a random synchronous signal according to the compared result, a first sampling signal generator for generating a first sampling signal in a synchronization block of a unit based on a first synchronous pattern sampled in the random synchronous signal outputted from the second comparator, a second sampling signal generator for generating a second sampling signal in a synchronization block of a unit based on a second synchronous pattern sampled in the random synchronous signal outputted from the second comparator, a third comparator for judging whether or not the first sampling signal is included in the random synchronous signal and generating a first reset signal for resetting the first sampling signal generator when the first sampling signal is not included in the random synchronous signal, to generate a third sampling signal as the first sampling signal, a fourth comparator for judging whether or not the second sampling signal is included in the random synchronous signal and generating a second reset signal for resetting the second sampling signal generator when the second sampling signal is not included in the random synchronous signal, to generate a fourth sampling signal as the second sampling signal, a first logic gate for outputting a first logically operated signal by a first logical operation of the first sampling signal generated by the first sampling signal generator and the second sampling signal generated by the second sampling signal generator, and a second logic gate for outputting a normal synchronous pattern by a second logical operation of the random synchronous signal from the second comparator and of the first logically operated signal from the first logic gate.

According to the present invention, an accurate sampling of the synchronous pattern from the read data including the error from the recording medium can be obtained. Therefore, an original image can be faithfully reproduced by judging each data region utilizing the synchronous pattern and carrying out a corresponding logical operation.

BRIEF DESCRIPTION OF THE DRAWINGS

The above objects and advantages of the present invention will become more apparent by describing in detail preferred embodiments thereof with reference to the attached drawings in which:

FIG. 2 is a block diagram illustrating an apparatus for sampling a synchronous pattern according to an embodiment of the present invention;

DETAILED DESCRIPTION OF THE INVENTION

Hereinafter, the preferred embodiments of the present invention will be explained in more detail with reference to the accompanying drawings.

Figure 1:
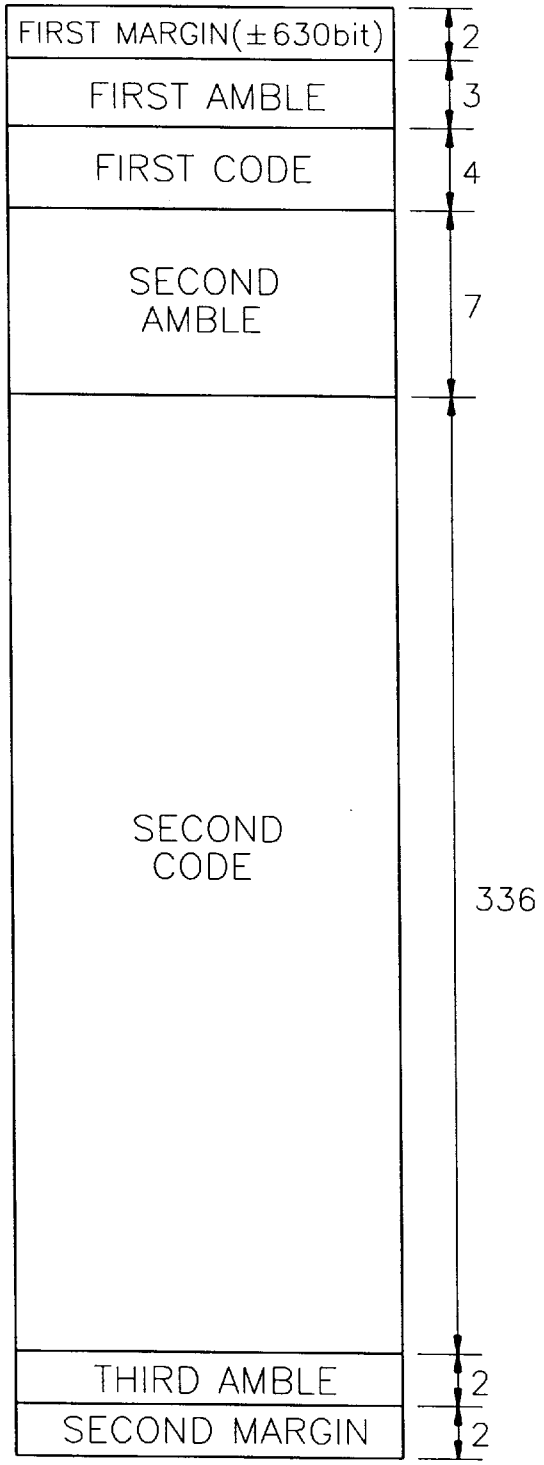
FIG. 1 is a view for explaining the structure of the track of a video tape for a general digital-video home system (D-VHS)

FIG. 1 is a view for explaining the structure of the track of a video tape for a general D-VHS. In the video tape for the D-VHS, one track consists of 356 synchronization blocks, including 2 blocks of a first margin region, 3 blocks of a first amble region, 4 blocks of a first code region, 7 blocks of a second amble region, 336 blocks of a second code region, 2 blocks of a third amble region, and 2 blocks of a second margin region. Here, in the first margin region data may be changed at a unit of ±630 bits, each synchronization block consists of 112 bytes, that is, 896 bits. The second code region consists of main data synchronization blocks, while first code region consists of sub-code synchronization blocks. At this time, one first code region consists of 4 sub-code synchronization blocks.

The present invention is directed to sample an accurate synchronous pattern synchronous concerning each data region irrespective of the identification of the data pattern of the first amble region with the synchronous pattern and the data pattern of the first code region, or the data pattern of the second amble region with the synchronous pattern and the data pattern of the second code region, because an error is generated by an external factor so that the synchronous patterns of the first and second codes are damaged.

FIG. 2 is a block diagram illustrating an apparatus for sampling a synchronous pattern according to an embodiment of the present invention. Referring to FIG. 2, an apparatus for sampling a synchronous pattern 20 includes a clock divider 200, a counter 202, a first comparator 204, a multiplexer 206, a second comparator 208, a shift register 210, first and second sampling signals generator 212 and 214, third and fourth comparator 216 and 218, an OR gate 220, an AND gate 222, and first and second register 224 and 226.

Clock divider 200 receives a system clock signal, divides the received system clock signal into the predetermined units, and provides a divided system clock signal to counter 202. Counter 202 counts a value by using the system clock signal which is divided by clock divider 200 and provides the counting value to first comparator 204. Shift register 210 receives data in serial, stores the data, and outputs to second comparator 208 in units of 14 bits. Second register 226 receives the system clock signal and the inputted data, and outputs data.

First comparator 204 compares the counting value measured by counter 202 with a standard (or reference) counting value and provides the compared resulting signal to multiplexer 206. Multiplexer 206 receives the compared resulting signal of first comparator 204 and selectively outputs to second comparator 208 a first code or a second code synchronous pattern according to the compared resulting signal. Second comparator 208 compares the output signal of multiplexer 206 with the pattern of data outputted from shift register 210 and inputted in serial, and outputs a random synchronous signal according to the compared result, respectively to first and second sampling signal generator 212 and 214, to third and fourth comparator 216 and 218, and to AND gate 222.

First sampling signal generator 212 generates a first sampling signal in a synchronization block of a unit based on the first synchronous pattern sampled in the random synchronous signal outputted from second comparator 208, and provides the first sampling signal to OR gate 220. Second sampling signal generator 214 generates a second sampling signal in a synchronization block of a unit based on the second synchronous pattern sampled in the random synchronous signal outputted from second comparator 208, and provides the second sampling signal to OR gate 220. OR gate 220 executes an OR operation of the first sampling signal generated by first sampling signal generator 212 and the second sampling signal generated by second sampling signal generator 214 and provides the OR operating result to AND gate 222. AND gate 222 executes an AND operation of the random synchronous signal from second comparator 208 and the OR operating signal from OR gate 220, samples the synchronous pattern, and provides the synchronous pattern to first register 224. First register 224 temporarily stores the synchronous pattern sampled by AND gate 222 and outputs at regular intervals.

The apparatus for sampling synchronous pattern 20 can be further provided with third comparator 216 for judging whether or not the first sampling signal is included in the random synchronous signal and generating a first reset signal for resetting first sampling signal generator 212 when the first sampling signal is not included in the random synchronous signal to correct the first sampling signal (that is, to generate a third sampling signal as the first sampling signal), fourth comparator 218 for judging whether or not the second sampling signal is included in the random synchronous signal and generating a second reset signal for resetting second sampling signal generator 214 when the second sampling signal is not included in the random synchronous signal to correct the second sampling signal (that is, to generate a fourth sampling signal as the second sampling signal), and second register 226 for temporarily storing the input data and outputting the data after sampling the synchronous pattern, for preventing the output of the input data before the sampled synchronous pattern is outputted.

Figure 3:
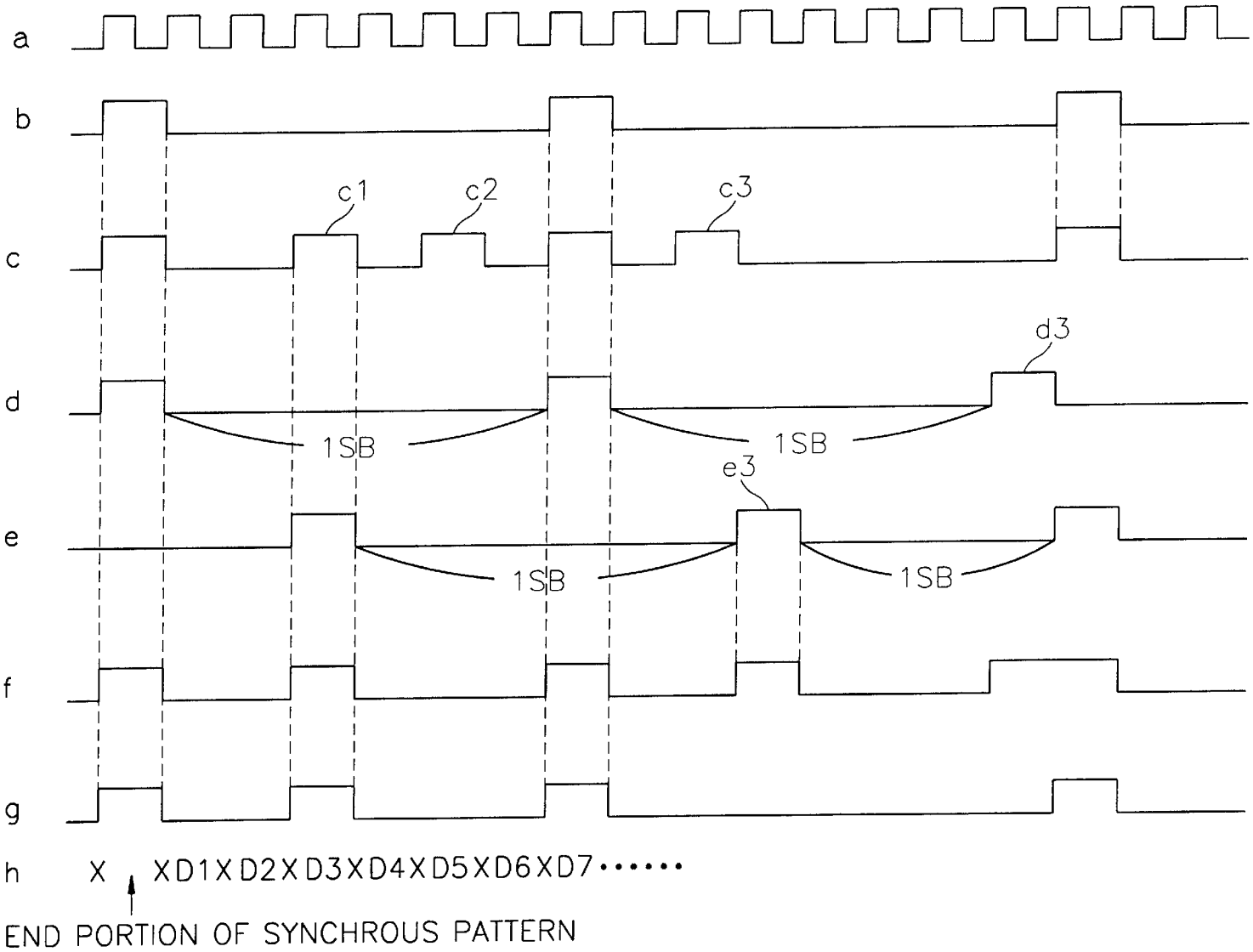
FIGS. 3(*a–h*) is an operational timing diagram for each component of the apparatus for sampling a synchronous pattern illustrated in FIG. 2.

FIGS. 3(*a–h*) is an operational timing diagram for each component of the apparatus for sampling a synchronous pattern illustrated in FIG. 2. FIG. 3(*a*) illustrates a system clock used in the present invention and FIG. 3(*b*) illustrates the normal synchronous pattern intended to be sampled by the present invention. FIG. 3(*c*) illustrates the synchronous pattern and the random synchronous signal including data having an identical pattern with the synchronous pattern. At this point, c1, c2 and c3 are data having the synchronous pattern. FIG. 3(*d*) illustrates the first sampling signal generated in a synchronization block of a unit based on the first synchronous pattern sampled in the random synchronous signal in FIG. 3(*c*). Here, d3 is an error signal occurred by the insertion of bits. FIG. 3(*e*) illustrates the second sampling signal generated in a synchronization block of a unit based on the second synchronous pattern sampled in the random synchronous signal in FIG. 3(*c*). Here, e3 is an error signal. FIG. 3(*f*) illustrates the operated signal of logical sum of the first sampling signal of FIG. 3(*d*) and the second sampling signal of FIG. 3(*e*), and FIG. 3(*g*) illustrates the operated signal of logical product of the random synchronous signal of FIG. 3(*c*) and the operated signal of logical sum of FIG. 3(*f*). FIG. 3(*h*) illustrates the input data outputted in serial.

Figure 4:
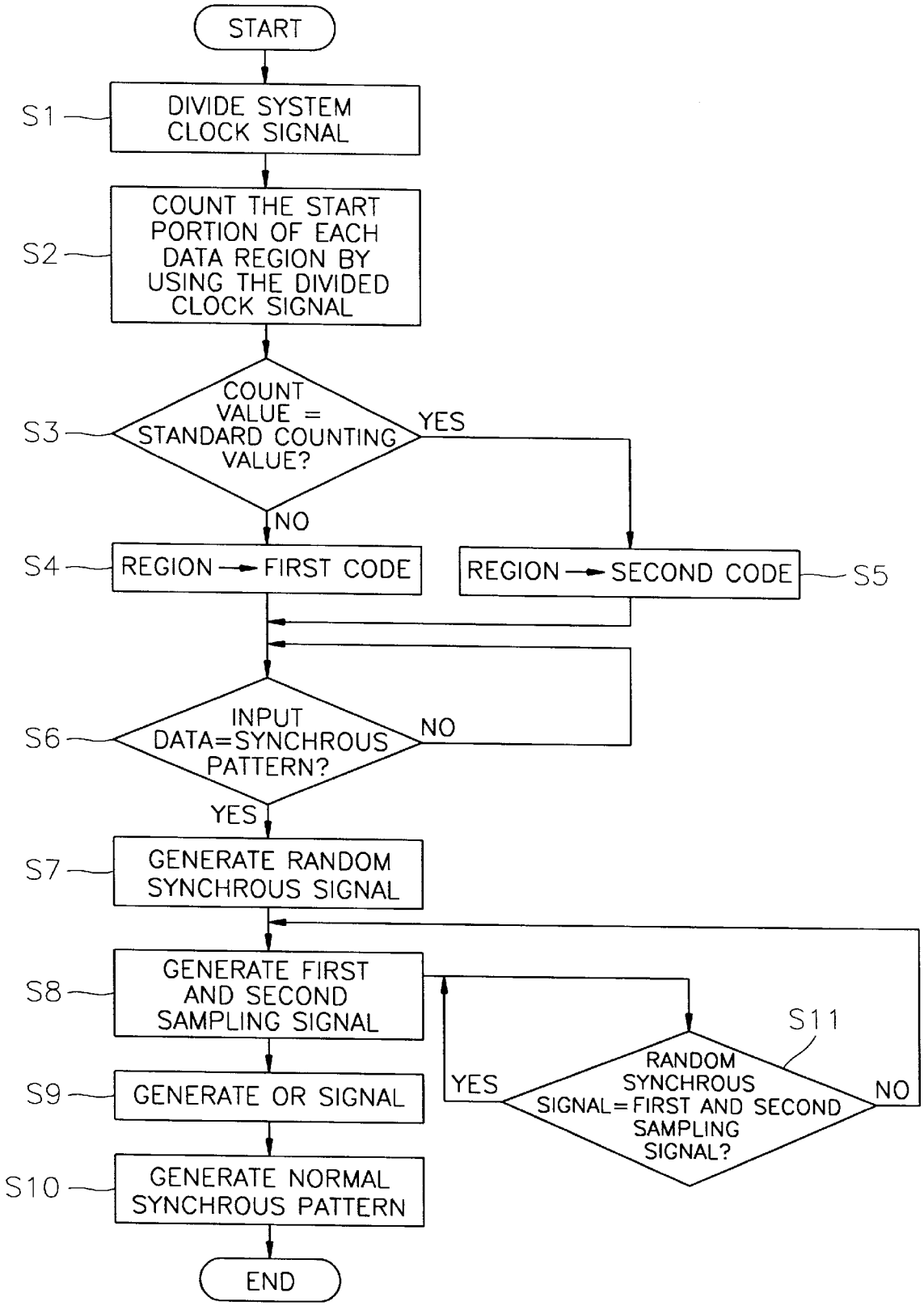
FIG. 4 is a flow chart illustrating a method for sampling a synchronous pattern according to an embodiment of the present invention.

FIG. 4 is a flow chart illustrating a method for sampling a synchronous pattern according to an embodiment of the present invention. Referring to FIG. 4, the method for sampling the synchronous pattern according to the present invention will be explained.

Clock divider 200 receives the system clock signal as illustrated in FIG. 3(*a*), divides the received system clock signal into the predetermined units, and provides to counter 202 (step S1). By dividing the system clock signal in this way, the frequency of counting of counter 202 can be reduced.

Counter 202 counts the system clock signal which is frequency divided by clock divider 200 up to an end portion of the second amble region in order to differentiate first and second code region concerning the data of the track structure as in FIG. 1 (step S2), and then provides the counting value to first comparator 204.

First comparator 204 compares the counting value of counter 202 with the standard counting value (step S3) and provides the compared resulting signal to multiplexer 206. Here, the standard counting value is established by the counting value to the starting portion of the second code region. Otherwise, the counting value to the starting portion of the first code region can be established as the standard counting value.

Multiplexer 206 receives the compared resulting signal of first comparator 204, that is, the judging signal of the present data region and selectively provides to second comparator 208 the synchronous pattern concerning the first code region or the second code region illustrated in FIG. 3(*b*). That is, when the counting value from counter 202 is different from the standard counting value when compared by first comparator 204, the present region is recognized as the first code region (step S4) and logical high signal "0" is provided to multiplexer 206. When multiplexer 206 receives the value of "0" from first comparator 204, the synchronous pattern of the first code, for example, "10110100011100", is provided to second comparator 208.

Meanwhile, when the counting value from counter 202 is the same as the standard counting value to the second code region in step S3, the present region is recognized as the second code region (step S5) and logical high signal "1" is provided to multiplexer 206. When multiplexer 206 receives the value of "1" from first comparator 204, the synchronous pattern of the second code, for example, "01001011100011", is provided to second comparator 208.

Meanwhile, shift register 210 stores the data inputted in serial and outputs in the same bit which is the same as the synchronous pattern outputted from multiplexer 206, e.g. in units of 14 bits to second comparator 208.

Second comparator 208 examines 14 bits data from shift register 210 with the synchronous pattern "10110100011100" of the first code or the synchronous pattern "01001011100011" of the second code from multiplexer 206 to determine whether they coincide or not. That is, second comparator 208 compares the synchronous pattern of the first code or the second code outputted from multiplexer 206 with the data pattern inputted in serial through shift register 210 (step S6) and generates the random synchronous signal as illustrated in FIG. 3(*c*), which consists of a signal identical to the synchronous pattern of the first code or the second code in the data pattern (step S7) when the synchronous pattern is identical with the data pattern.

The random synchronous signal is provided to first and second sampling signal generator 212 and 214, third and fourth comparator 216 and 218, and AND gate 222, respectively.

First sampling signal generator 212 generates the first sampling signal illustrated in FIG. 3(*d*) in a synchronization block of a unit, based on the first synchronous pattern sampled in the random synchronous signal outputted from second comparator 208 (step S8), and provides the first sampling signal to OR gate 220. Second sampling signal generator 214 generates the second sampling signal illustrated in FIG. 3(*e*) in a synchronization block of a unit, based on the second synchronous pattern sampled in the random synchronous signal outputted from second comparator 208 (step S8), and provides the second sampling signal to OR gate 220.

OR gate 220 generates an OR signal by the operation of logic sum of the first sampling signal generated by first sampling signal generator 212 and the second sampling signal generated by second sampling signal generator 214 (step S9), and provides the operated signal of logic sum to AND gate 222.

AND gate 222 samples the normal synchronous pattern illustrated in FIG. 3(*b*) by the operation of logic product of the random synchronous signal outputted from second comparator 208 and of the operated signal of logic sum outputted from OR gate 220 (step S10), and provides to first register 224. First register 224 temporarily stores the synchronous pattern sampled by AND gate 222 and outputs at regular intervals.

Meanwhile, third comparator 216 examines whether or not the first sampling signal is included in the random synchronous signal and generates the first reset signal for resetting first sampling signal generator 212 to correct the first sampling signal and to generate a third sampling signal as a new first sampling signal when the first sampling signal is not included in the random synchronous signal. Fourth comparator 218 examines whether or not the second sampling signal is included in the random synchronous signal and generates the second reset signal for resetting second sampling signal generator 214 to correct the second sampling signal and to generate a fourth sampling signal as a new second sampling signal when the second sampling signal is not included in the random synchronous signal (step S11). When the first and second sampling signals are included in the random synchronous signal, step S11 is repeated performed.

Second register 226 temporarily stores the input data to shift register 210 and outputs in the shape illustrated in FIG. 3(*h*) after the output of the sampled synchronous pattern in order to prevent the output of the input data before the synchronous pattern.

In the method for sampling the synchronous pattern according to the present invention, the system clock signal is received and counted in order to differentiate each data region concerning the read data from the recording medium having a track structure. The counting value is compared with the standard counting value and the present region is judged according to the compared result to generate the same random synchronous signal identical with the synchronous pattern concerning the data region judged from each data region of the read data. In the random synchronous signal, the first and the second sampling signals are generated in a synchronization block of a unit based on the first generated synchronous pattern and the second generated synchronous pattern, and the normal synchronous pattern is sampled based on the random synchronous signal and the first and the second sampling signals.

According to the present invention, it is possible to accurately sample the synchronous pattern from the read data including an error from the recording medium. Accordingly, an original image can be faithfully reproduced by judging each data region and carrying out a corresponding operation by using the synchronous pattern. Therefore, the present invention can be utilized in sampling the synchronous pattern of the data for the D-VHS or a compact disk-read only memory (CD-ROM). In addition, the present invention can be applied to other fields for sampling the synchronous pattern of data stored in digital form.

Although the preferred embodiment of the invention has been described, it is understood that the present invention should not be limited to the preferred embodiment, but various changes and modifications can be made by one skilled in the art within the spirit and scope of the invention as hereinafter claimed.

What is claimed is:

1. A method for sampling a synchronous pattern comprising the steps of:

receiving a system clock signal and counting a value by using the system clock signal to differentiate each data region concerning read data from a recording medium having a track structure using the received system clock signal;

comparing the counting value with a standard counting value and judging a present data region according to a compared result;

generating a random synchronous signal identical with a synchronous pattern concerning a judged data region from each data region of said read data;

generating first and second sampling signals in a synchronization block of a unit, based on a first synchronous pattern and a second synchronous pattern generated from said random synchronous signal, respectively;

correcting the first and second sampling signals when the first and second sampling signals are not identical with the random synchronous signal; and sampling a normal synchronous pattern concerning each data region based on said random synchronous signal and the first and second sampling signals.

2. A method for sampling a synchronous pattern as claimed in claim 1, wherein the standard counting value is a counting value to a starting portion of a second code region.

3. A method for sampling a synchronous pattern as claimed in claim 1, wherein said step of sampling a normal synchronous pattern comprises the substeps of:

carrying out an operation of logical sum concerning the first sampling signal and the second sampling signal; and sampling a normal synchronous pattern concerning each data region by carrying out an operation of logical product of an operated signal of the logical sum and the random synchronous signal.

4. A method for sampling a synchronous pattern as claimed in claim 1, further comprising the step of dividing the received system clock signal into predetermined units after receiving the system clock signal.

5. An apparatus for sampling a synchronous pattern comprising:

a counter for receiving a system clock signal and counting a value by using the system clock signal for differentiating each data region concerning read data from a recording medium having a track structure by using the received system clock signal;

a first comparator for comparing a counting value obtained by said counter with a standard counting value and judging a present data region;

a multiplexer for receiving a compared resulting signal of said first comparator and selectively outputting a synchronous pattern of a first code and a synchronous pattern of a second code according to the compared resulting signal;

a second comparator for comparing an outputted signal of said multiplexer with a pattern of said read data inputted in serial and outputting a random synchronous signal according to the compared result;

a first sampling signal generator for generating a first sampling signal in a synchronization block of a unit based on a first synchronous pattern sampled in the random synchronous signal outputted from said second comparator;

a second sampling signal generator for generating a second sampling signal in a synchronization block of a unit based on a second synchronous pattern sampled in the random synchronous signal outputted from said second comparator;

a first logic gate for outputting a first logically operated signal by a first logical operation of the first sampling signal generated by said first sampling signal generator and the second sampling signal generated by said second sampling signal generator; and a second logic gate for outputting a normal synchronous pattern by a second logical operation of the random synchronous signal from said second comparator and the first logically operated signal from said first logic gate.

6. An apparatus for sampling a synchronous pattern as claimed in claim 5, wherein said standard counting value is a counting value to a starting portion of a second code region.

7. An apparatus for sampling a synchronous pattern as claimed in claim 5, wherein said multiplexer outputs a first code synchronous pattern when the counting value of said counter is different from the standard counting value, and outputs a second code synchronous pattern when the counting value of said counter is equivalent to the standard counting value, according to a compared result of said first comparator.

8. An apparatus for sampling a synchronous pattern as claimed in claim 5, wherein said second comparator outputs the random synchronous signal when the outputted signal of said multiplexer and when the pattern of said read data inputted in serial are identical with each other.

9. An apparatus for sampling a synchronous pattern as claimed in claim 5, wherein said first logic gate comprises an OR gate for operating a logical sum of the first sampling signal and the second sampling signal.

10. An apparatus for sampling a synchronous pattern as claimed in claim 5, wherein said second logic gate comprises an AND gate for operating a logical product of the random synchronous signal and the first logically operated signal.

11. An apparatus for sampling a synchronous pattern as claimed in claim 5, further comprising a clock divider for dividing the received system clock signal into predetermined units and supplying a divided signal to said counter in order to reduce a counting value of said counter.

12. An apparatus for sampling a synchronous pattern as claimed in claim 5, further comprising a shift register for storing the input data in serial and outputting in a same bit of unit as the synchronous pattern outputted from said multiplexer to said second comparator.

13. An apparatus for sampling a synchronous pattern as claimed in claim 5, further comprising a third comparator for examining whether or not the first sampling signal is included in the random synchronous signal and generating a first reset signal for resetting said first sampling signal generator when the first sampling signal is not included in the random synchronous signal.

14. An apparatus for sampling a synchronous pattern as claimed in claim 5, further comprising a fourth comparator for examining whether or not the second sampling signal is included in the random synchronous signal and generating a second reset signal for resetting said second sampling signal generator when the second sampling signal is not included in the random synchronous signal.

15. An apparatus for sampling a synchronous pattern as claimed in claim 5, further comprising a first register for temporarily storing said synchronous pattern sampled by said second logic gate and outputting the synchronous pattern at regular intervals.

16. An apparatus for sampling a synchronous pattern as claimed in claim 5, further comprising a second register for temporarily storing the input data and outputting the input data after outputting the normal synchronous pattern in order to prevent an output of the input data before the sampled synchronous pattern is outputted.

* * * * *